US008225801B2

(12) United States Patent
Keurinck

(10) Patent No.: US 8,225,801 B2
(45) Date of Patent: Jul. 24, 2012

(54) MASCARA APPLICATOR

(75) Inventor: Marie Keurinck, Paris (FR)

(73) Assignee: LVMH Fragrance Brands, Levallois Perret (FR)

( * ) Notice: Subject to any disclaimer, the term of this patent is extended or adjusted under 35 U.S.C. 154(b) by 471 days.

(21) Appl. No.: 11/911,786

(22) PCT Filed: Apr. 14, 2006

(86) PCT No.: PCT/FR2006/000832

§ 371 (c)(1),
(2), (4) Date: Oct. 17, 2007

(87) PCT Pub. No.: WO2006/111645

PCT Pub. Date: Oct. 26, 2006

(65) Prior Publication Data

US 2008/0202546 A1 Aug. 28, 2008

(30) Foreign Application Priority Data

Apr. 19, 2005 (FR) ..... 05 03904

(51) Int. Cl.
*A45D 40/26* (2006.01)
*A46B 11/00* (2006.01)

(52) U.S. Cl. ..... 132/218; 401/129

(58) Field of Classification Search ..... 132/218, 132/120, 320; 401/126, 129–131; 15/167.1, 15/160, 159.1

See application file for complete search history.

(56) References Cited

U.S. PATENT DOCUMENTS

| | | | | |
|---|---|---|---|---|
| 1,671,891 | A * | 5/1928 | Dolan | 15/167.1 |
| 2,975,452 | A * | 3/1961 | Doull et al. | 15/209.1 |
| 4,404,977 | A | 9/1983 | Vasas | |
| 5,636,931 | A | 6/1997 | Gueret | |
| 5,803,638 | A * | 9/1998 | Gueret | 401/122 |
| 6,082,918 | A | 7/2000 | Gueret | |
| 7,231,926 | B2 * | 6/2007 | Kim | 132/218 |
| 2002/0090591 | A1 * | 7/2002 | Fischer | 433/90 |
| 2002/0144702 | A1 | 10/2002 | Gueret | |

FOREIGN PATENT DOCUMENTS

| | | |
|---|---|---|
| EP | 1 034 722 A2 | 9/2000 |
| EP | 1034722 | 9/2000 |
| EP | 1 247 472 A1 | 9/2002 |
| FR | 2 753 353 A1 | 3/1998 |
| FR | 2753353 | 3/1998 |
| JP | H11-253228 | 9/1999 |
| JP | 2002-172019 | 6/2002 |

OTHER PUBLICATIONS

French Search Report and written opinion FR 0503904 dated Nov. 28, 2005.

* cited by examiner

*Primary Examiner* — Robyn Doan

(74) *Attorney, Agent, or Firm* — Miller, Matthias & Hull LLP

(57) ABSTRACT

The invention concerns a mascara applicator comprising a rod or the like including one end supporting a brush-forming applying part, said rod having at least proximate the brush a main axis, such brush being provided with a plurality of bristles systematically distributed about said main axis, the bristles of said brush being all of the same length and oriented in divergent manner substantially from a central point located substantially at said end of the rod, in all the directions of the space inside a cone having as apex the central point and whereof the apex angle measurement is not less than about 230°, preferably not less than 300°.

15 Claims, 2 Drawing Sheets

MASCARA APPLICATOR

FIELD OF THE DISCLOSURE

The subject of the present invention is essentially a mascara applicator.

It is known that mascara applicators generally comprise a wand extended at one end by an applicator part equipped with bristles over its length, which form a brush, and comprising toward the other end a part that forms a handle.

BACKGROUND OF THE DISCLOSURE

However, the various applicators proposed, especially as regards the distribution and orientation of the bristles of the brush, make it difficult to satisfactorily make up the eyelashes, especially when it is desired to thoroughly separate and spread out the eyelashes from the base to create a very visible "volumizing" effect and, on the other hand, when it is desired to apply a large amount of mascara over the entire length of the eyelashes while avoiding the formation of "clumps" of product, and this, regardless of the size of the eyelashes of the user.

SUMMARY OF THE DISCLOSURE

Thus, one feature of the present invention is to overcome, in particular, these drawbacks by providing an applicator comprising a brush that makes it possible to load the eyelashes with a large amount of mascara over their entire length, that is to say from their base level with the edge of the eyelids up to their end, without the formation of unsightly agglomerates, or "clumps", of product, while separating the eyelashes, in order to increase the "volumizing" effect, that is to say the impression of more abundant eyelashes.

For this purpose, the subject of the invention is a mascara applicator comprising a wand or the like comprising, on the one hand, a first end bearing an applicator part that forms a brush and, on the other hand, a part that forms a handle located toward the second end of said wand, opposite said first end, said wand having at least, in the vicinity of the applicator part, one main axis, said brush being provided with a plurality of bristles distributed symmetrically about said main axis, wherein the bristles of said bush are all of the same length and are oriented so as to diverge substantially from a central point located approximately at said first end of the wand, in all directions in space within a cone having said central point as its apex and through which the wand extends and the apex angle of which the cone is less than or equal to about 130°, preferably less than or equal to 60°.

According to one preferred embodiment of the invention, the length of the bristles of said brush lies between about 1 and 4.5 millimeters, preferably between about 2 and 3 millimeters.

According to another preferred embodiment, the bristles are approximately all of the same length so that the brush at the end of the bristles has the shape of an approximately spherical cap, the area of the spherical part of which represents about at least 70%, and preferably at least 93% of the total area of a sphere having the same diameter.

Advantageously, the diameter of the sphere corresponding to said approximately spherical cap of the mascara brush according to the invention measures around 3 to 10 millimeters, preferably around 4.5 to 8 millimeters.

According to another embodiment of the invention, said wand is fixed to the inside of a closure cap by its part that forms a handle, said closure cap being intended to seal, by screwing, clip fastening or other means, a receptacle, or little bottle, containing the mascara.

BRIEF DESCRIPTION OF THE DRAWINGS

But other features and advantages of the invention will appear more clearly in the detailed description which follows and refers to the appended drawings, given solely by way of example, and in which.

DETAILED DESCRIPTION

Seen in the figures is an applicator enabling a mascara to be applied to one's eyelashes, and comprising a wand 1 or the like that comprises, on the one hand, a first end 2 bearing an applicator part that forms a brush 3 and, on the other hand, a part 4 that forms a handle located toward the second end of said wand, opposite said first end 2.

In the examples represented in the figures, the wand 1 is rectilinear But, without departing from the scope of the invention, it could comprise a curved part, in particular at the part 4 that forms a handle.

Figure 1:
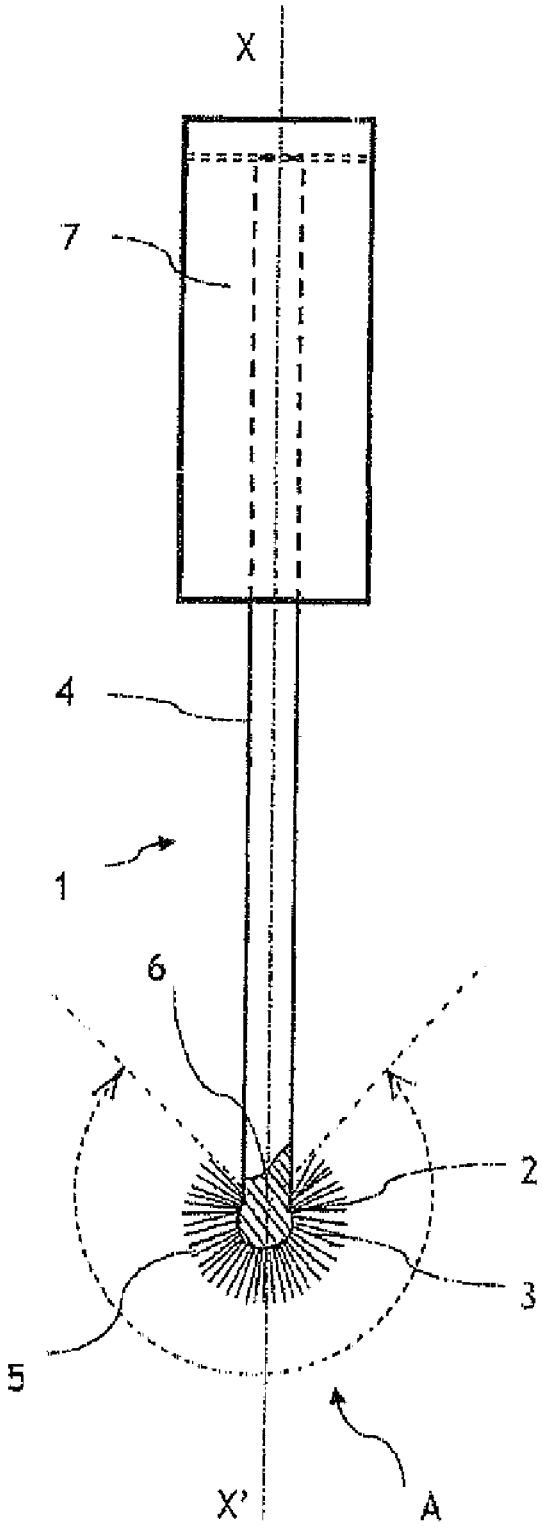
FIG. 1 is a schematic partial cross-sectional view of a mascara applicator according to the present invention.
Figure 2:
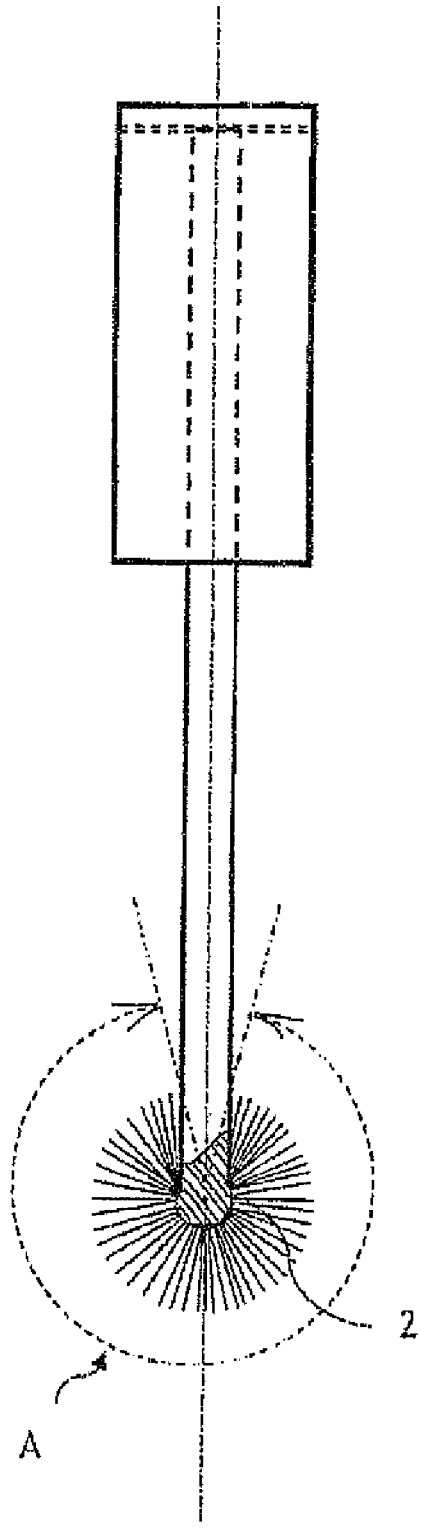
FIG. 2 is a similar view to FIG. 1 but representing a variant of such an applicator.

As can be seen in the figures, the brush 3 is provided with a plurality of bristles 5. These bristles are oriented in a divergent manner starting from a central point 6 located approximately at the end 2 of the wand, in all directions in space except within a cone or conical space having said central point 6 as its apex and the apex angle of the conical space being the explement of the angle A or the apex of the cone or conical space shown in FIGS. 1 and 2 is less than about 130°. It is therefore understood that the angle A is a reflex angle. In the embodiment represented in FIG. 1, the apex angle of the conical space measures a little under 100°or the angle shown at A measures a little 260°. In that represented in FIG. 2, the apex angle of the conical space is close to 20°or the angle A is close to 340°.

Moreover, the bristles 5 of the brushes represented in the appended figures all have an approximately identical length, so that at their end, the brush 3 has the shape of an approximately spherical cap. In the example from FIG. 1, the area of the spherical part of said cap represents a little over 80% of the total area of the corresponding sphere. In that represented in FIG. 2, the shape of the brush 3 is an almost complete sphere.

It should be noted that the attachment of the bristles of the brush is carried out according to well-known techniques. For example, they may be attached to the inside of one or more loops of metal wire, not shown in the figures.

The nature of the fibers forming the bristles 5 is natural or synthetic and corresponds to that generally used in the various types of mascara brush. However, in order to carry out the present invention, bristles having a good rigidity will preferably be used.

The diameter of the spherical surface of the brush must be large enough to enable a correct loading of product to be applied to the eyelashes; however, the length of the bristles 5 must remain in line with the average length of the eyelashes for a given population and must enable makeup to be applied with sufficient precision. Preferably, this diameter must lie between about 3 and 10 millimeters, more preferably between about 4.5 and 8 millimeters. The length of the bristles themselves advantageously lies between about 1 and 4.5 millimeters, preferably between about 2 and 3 millimeters.

The mascara brush according to the invention makes it possible to apply any type of mascara formulation, having a liquid, pasty or even solid consistency. When it is a solid mascara, often called a "cake mascara", a supply of liquid, generally aqueous liquid, is required to remove, using the brush, the amount of product needed for the application to the eyelashes.

For the use of liquid or pasty mascaras, the applicator brush is generally attached to the inside of the closure cap intended to seal, preferably by screwing, the receptacle containing the mascara, so that when the receptacle is closed, the brush is located inside the product. This is the case represented in the appended figures.

Figure 3:
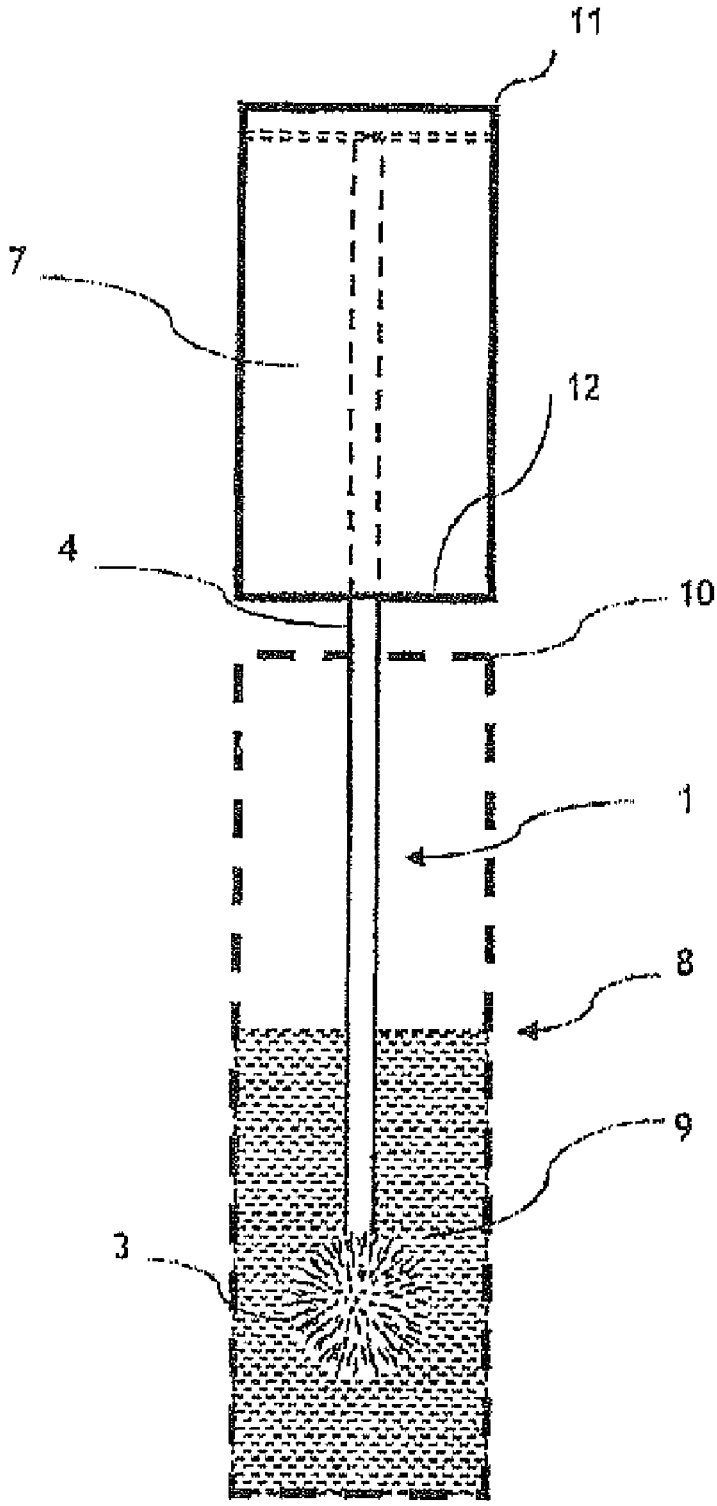
FIG. 3 is a schematic elevation of a mascara applicator according to the invention partially introduced into a receptacle containing the mascara.

In FIG. 3, it is possible to see the mascara applicator according to the invention partially introduced into a receptacle 8, represented schematically by dotted lines, containing a liquid mascara 9 and comprising an opening 10 Mounted inside the receptacle 8, in the vicinity of the opening 10, is a wiping member, not shown in FIG. 3, for removing the surplus mascara before application to the eyelashes. The wand 1 of the applicator is attached via its part 4 that forms a handle to the bottom 11 of the closure cap 7 intended to seal the receptacle 8 at its opening 12. In the position shown in this figure, the brush 3, of spherical shape, is located in the liquid mascara 9.

Thus, due to its structural features described above, the mascara applicator has many advantages over the applicators that are already known.

Especially, the particular arrangement of the bristles of the applicator part that form a brush facilitate the separation of the eyelashes from one another right from their base, practically level with the edge of the eyelid, and thus promote their spreading out. The eyelashes may therefore be coated with mascara over their entire length. The eyelashes are practically not amalgamated together. The brush according to the invention produces, on the eyelashes thus separated and coated, a "volumizing" effect. The eyelashes appear more abundant, thicker, and more numerous.

Another advantage of the applicator according to the invention is a more homogeneous distribution of the mascara on the bristles of the brush and, consequently, also on the eyelashes. The formation of unattractive "clumps" of product is therefore practically avoided.

It should be noted that in order to obtain the best results for making up the eyelashes, the brush according to the invention must comprise bristles that are neither too close together, especially so that the eyelashes are well separated, nor too spaced out in order to produce an optimum coating of the eyelashes.

As has already been indicated above, the applicator according to the invention may be used with any type of mascara. However, the brush according to the invention produces optimum effects with mascaras of fluid formulation, which dry quite slowly on application. This makes it possible, if necessary, to pass the mascara over the eyelashes several times without so much as risking forming clumps of product.

It should be stated that the invention comprises all the equivalent techniques of the means described and also their combinations when these fall within the scope of the claims which follow.

The invention claimed is:

1. A mascara applicator device comprising:

a receptacle containing mascara adapted for eyelashes and having an opening; and a mascara applicator comprising a wand extending between first and second ends, said first end bearing a brush and said second end being secured to a closure cap forming a handle, said wand extending along a main axis at least in the vicinity of the brush, said brush being provided with a plurality of bristles distributed symmetrically relative to said main axis, wherein the bristles of said brush are all of the same length and are oriented so as to diverge substantially from a central point located substantially at said first end of the wand, in all directions in space away from the second end of the wand, no bristle being provided within a conical space through which the wand extends, the conical space having said central point as an apex and having an apex angle which is less than about 130°, and wherein the brush is disposed such that said brush is located inside the mascara when the opening of the receptacle is closed by the closure cap, whereby the brush facilitates the separation of the eyelashes from one another right from their base, and whereby the brush produces an optimum coating of the eyelashes.

2. The applicator device as claimed in claim 1, wherein the bristles of said brush have a length lying between about 1 and 4.5 millimeters.

3. The applicator device as claimed in claim 2, wherein the bristles of said brush have a length lying between about 2 and 3 millimeters.

4. The applicator device as claimed in claim 1, wherein the brush has a shape of a substantially spherical cap, having an area representing about at least 70% of the total area of a sphere having the same diameter.

5. The applicator device as claimed in claim 4, wherein the diameter of the sphere corresponding to said substantially spherical cap measures around 3 to 10 millimeters.

6. The applicator device as claimed in claim 5, wherein the diameter of the sphere corresponding to said substantially spherical cap measures around 4.5 to 8 millimeters.

7. A mascara applicator device comprising:

a receptacle containing mascara and having an opening; and a mascara applicator comprising a wand extending between first and second ends, said first end bearing a brush and said second end being secured to a closure cap forming a handle, said wand extending along a main axis at least in the vicinity of the brush, said brush being provided with a plurality of bristles distributed symmetrically relative to said main axis, wherein the bristles of said brush are all of the same length and are oriented so as to diverge substantially from a central point located substantially at said first end of the wand, in all directions in space away from the second end of the wand, no bristle being provided within a conical space through which the wand extends, the conical space having said central point as an apex and having an apex angle of 60° or less, wherein the brush is disposed such that said brush is located inside the mascara when the opening of the receptacle is closed by the closure cap.

8. The applicator device as claimed in claim 7, wherein the bristles of said brush have a length lying between about 1 and 4.5 millimeters.

9. The applicator device as claimed in claim 8, wherein the bristles of said brush have a length lying between about 2 and 3 millimeters.

10. The applicator device as claimed in claim 7 wherein the brush has a shape of a substantially spherical cap having an area representing about at least 70% of the total area of a sphere having the same diameter.

11. The applicator device as claimed in claim 10, wherein the diameter of the sphere corresponding to said substantially spherical cap measures around 3 to 10 millimeters.

12. The applicator device as claimed in claim 11, wherein the diameter of the sphere corresponding to said substantially spherical cap measures around 4.5 to 8 millimeters.

13. The applicator device as claimed in claim 7, wherein the brush has a shape of a substantially spherical cap having an area representing about at least 93% of the total area of a sphere having the same diameter.

14. The applicator device as claimed in claim 13, wherein the diameter of the sphere corresponding to said substantially spherical cap measures around 3 to 10 millimeters.

15. The applicator device as claimed in claim 14, wherein the diameter of the sphere corresponding to said substantially spherical cap measures around 4.5 to 8 millimeters.

* * * * *